US012391442B2

(12) United States Patent
Bram et al.

(10) Patent No.: US 12,391,442 B2
(45) Date of Patent: Aug. 19, 2025

(54) CONTAINER LID

(71) Applicant: Brumis Imports Inc., New York, NY (US)

(72) Inventors: Steven Bram, New York, NY (US); Sean Fogarty, Huntington, NY (US)

(73) Assignee: Brumis Imports Inc., New York, NY (US)

( * ) Notice: Subject to any disclaimer, the term of this patent is extended or adjusted under 35 U.S.C. 154(b) by 0 days.

(21) Appl. No.: 18/592,614

(22) Filed: Mar. 1, 2024

(65) Prior Publication Data

US 2024/0294310 A1 Sep. 5, 2024

Related U.S. Application Data

(60) Provisional application No. 63/449,790, filed on Mar. 3, 2023.

(51) Int. Cl.
*B65D 51/18* (2006.01)

(52) U.S. Cl.
CPC ..... *B65D 51/18* (2013.01); *B65D 2251/0021* (2013.01); *B65D 2251/0081* (2013.01)

(58) Field of Classification Search
CPC ..... B65D 51/18; B65D 43/16; B65D 43/161; B65D 43/162; B65D 43/163; B65D 43/164; B65D 43/18; B65D 43/20
See application file for complete search history.

(56) References Cited

U.S. PATENT DOCUMENTS

| | | | | |
|---|---|---|---|---|
| 2016/0088960 | A1* | 3/2016 | Liang | B65D 81/3869 220/560.01 |
| 2019/0283940 | A1* | 9/2019 | Savenok | B65D 51/1611 |
| 2019/0308779 | A1* | 10/2019 | Harris | B65D 51/24 |
| 2023/0018909 | A1* | 1/2023 | Harris | B65D 43/0212 |
| 2024/0034524 | A1* | 2/2024 | Lewandowski | B65D 51/1672 |
| 2024/0083641 | A1* | 3/2024 | Wong | B65D 51/18 |

* cited by examiner

*Primary Examiner* — Javier A Pagan
(74) *Attorney, Agent, or Firm* — Amster, Rothstein & Ebenstein LLP

(57) ABSTRACT

A lid for use on a container includes a drinking opening with a first cover that selectively opens and closes the drinking opening and a filling opening with a second cover that selectively opens and closes the filling opening. The first cover may be moved using a first actuator and the second cover may be moved using a second actuator. A lock element may be used to selectively lock the first actuator and the second actuator to keep the drinking opening and the filling opening closed when desired.

12 Claims, 6 Drawing Sheets

CONTAINER LID

CROSS-REFERENCE TO RELATED APPLICATIONS

The present application claims benefit of and priority to U.S. Provisional Patent Application Ser. No. 63/449,790 filed Mar. 3, 2023 entitled CONTAINER LID, the entire contents of which are incorporated by reference herein.

BACKGROUND

Field of the Disclosure

The present invention relates to a lid for use with a container, such as a coffee mug, that includes a sealable drinking opening that is selectively covered by a first cover element and a filling opening that is selectively covered by a second cover element. The first cover element may be actuated by a first actuator to allow a user to drink with the lid in place while the second cover element may be actuated by a second actuator to allow filling of the container on which the lid is mounted without removing the lid. The first actuator and second actuator are actuated separately and a lock element may be provided to lock the first actuator and second actuator in place and prevent liquid from exiting the container via the lid.

Related Art

Conventional containers for hot beverages, and cold beverages, that include lids with drinking openings that can be selectively unsealed for drinking typically must be removed in order to allow for filling of the container. In general, these conventional lids include a single opening configured to allow a small amount of liquid to escape to allow a user to drink. These conventional lids therefore do not allow for refilling of the container while the lid is in place.

It would be beneficial to provide a lid for a container that avoids these and other problems.

SUMMARY

It is an object of the present disclosure to provide a lid for a container that includes a drink opening selectively covered by a first cover based on activation of a first actuator and a filling opening selectively covered by a second cover based on activation of a second actuator. The lid may include a lock element that may be used to lock the first actuator and the second actuator in place to prevent liquid from passing through either the drink opening or the filling opening.

A lid for a container in accordance with an embodiment of the present disclosure includes: a base configured to be secured to an open end of a container; the base including: a central filling opening configured for fluid communication with the open end of the container; a first cover movably mounted in the base and movable between a closed position covering the central opening and an open position in which the central opening is open; a first actuator operatively connected to the first cover and configured to selectively secure the first cover in the closed position such that the first cover is movable to the open position after activation of the first actuator; a drink opening provided on one side of the base and separate from the central opening; a drink opening seal movably mounted in the base and configured to move from a first position sealing the drink opening and a second position in which the drink opening is exposed, the drink opening seal biased in the first position; and a second actuator mounted in the first cover and operably connected to the drink opening seal assembly such that activation of the second actuator moves the drink opening seal into the second position.

In embodiments, the central filling opening is larger than the drink opening and configured for filling of the container with fluid.

In embodiments, the first actuator comprises a first protrusion configured to engage the base to hold the first cover in the closed position, where the first actuator is movable in a first direction to move the first protrusion away from the base to allow the first cover to move to the open position.

In embodiments, the base includes a first slot formed in a sidewall thereof and configured to receive the first protrusion.

In embodiments, the drink opening seal is biased into the first position to seal the drink opening.

In embodiments, the drink opening seal is mounted on a first end of a drink opening arm, wherein the drink opening arm is movably mounted on the base and operably connected to the first actuator to move the drink opening seal from the first position to the second position.

In embodiments, the second actuator slides from a first position in which the drink opening seal is covered, inward, toward a central axis of the lid, to move the drink opening seal to the second position in which the drink opening seal uncovers to drink opening to allow fluid to pass out of the drink opening.

In embodiments, the lid includes a pivot disk mounted in the first cover and in contact with the drink opening arm and the second actuator, wherein the pivot disk is substantially flush with a bottom surface of the first cover when the drink opening seal is in the first position and pivots downward to push down on the drink opening arm to move the drink opening seal to the second position to uncover the drink opening when the second actuator slides into the second position.

In embodiments, the lid includes a pin configured to connect a distal end of the second actuator to the pivot disk such that movement of the second actuator toward the central axis of the lid pivots the pivot disk downward.

In embodiments, the distal end of the second actuator includes a downward angled loop and the pivot disk includes an upwardly extending loop, wherein the pin extends through the downward angled loop and the upwardly extending loop such that movement of the second actuator inward toward the central axis moves the pivot disk down.

In embodiments, a lock element is mounted in the second cover and movable between a locked position in which activation of the first actuator and the second actuator is prevented and an unlocked position wherein the first actuator and the second actuator are movable.

In embodiments, the lock element is configured to selectively lock the first actuator and the second actuator to prevent activation.

BRIEF DESCRIPTION OF THE DRAWINGS

The above and related objects, features and advantages of the present disclosure will be more fully understood by reference to the following, detailed description of the preferred, albeit illustrative, embodiments of the present invention when taken in conjunction with the accompanying figures, wherein.

DETAILED DESCRIPTION OF THE EXEMPLARY EMBODIMENTS

Figure 2:
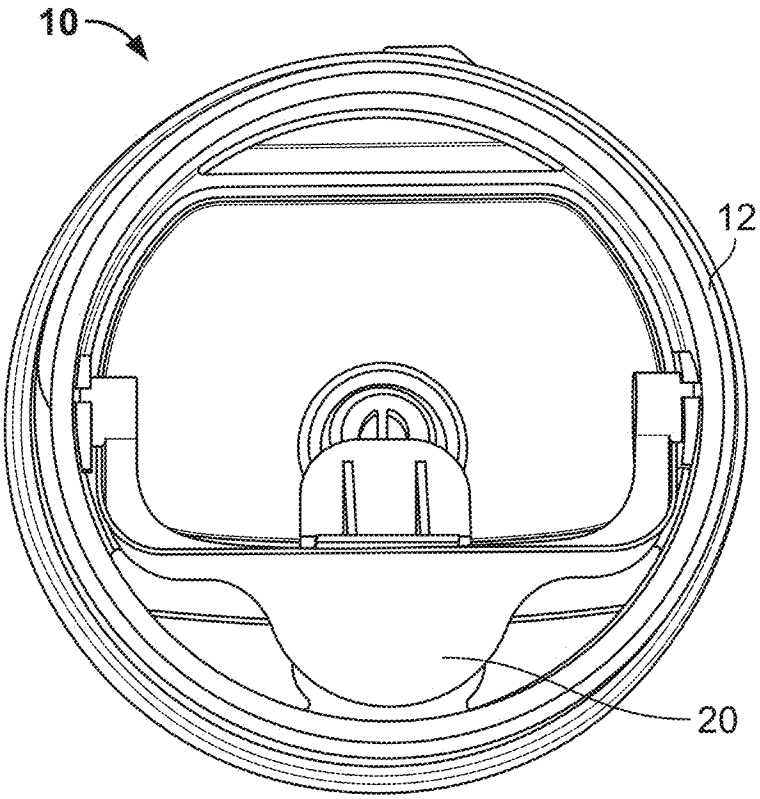
FIG. 2 illustrates a bottom view of the lid of FIG. 1 in accordance with an embodiment of the present disclosure.
Figure 1:
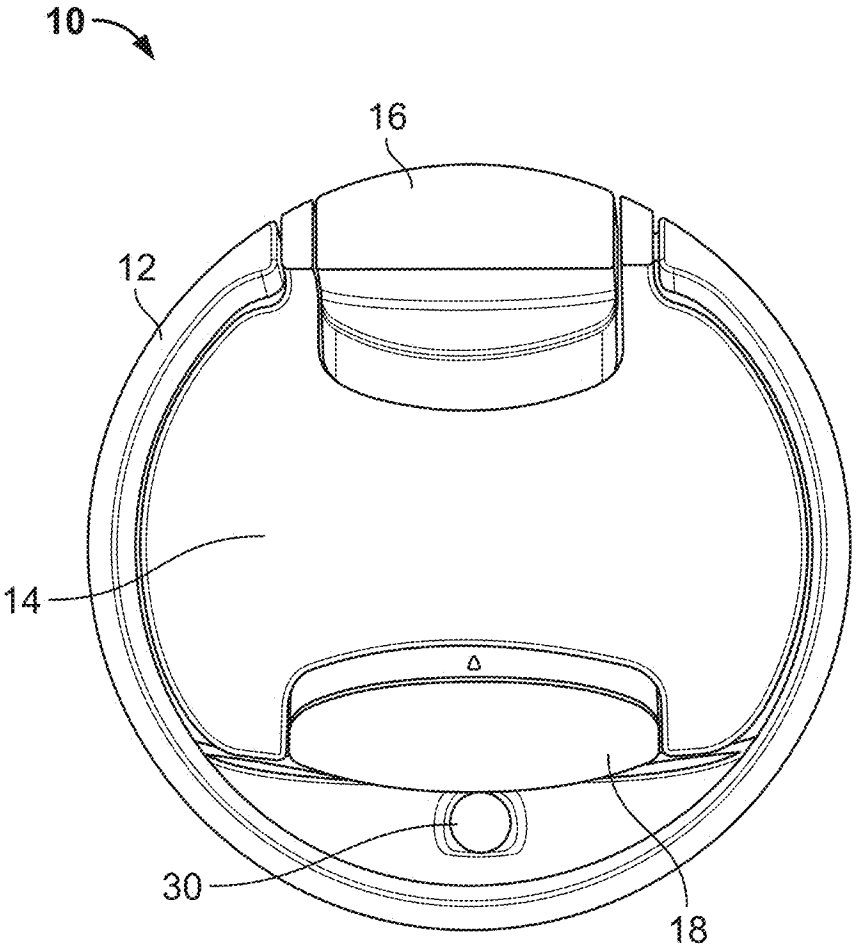
FIG. 1 illustrates a top view of a lid in accordance with an embodiments of the present disclosure.

A top view of a lid 10 in accordance with an embodiment of the present disclosure is illustrated in FIG. 1. FIG. 2 illustrates a bottom view of the lid 10 of FIG. 1. In embodiments, the lid 10 may be configured to be mounted on a container such as a coffee mug or other container. In embodiments the lid 10 may include a base 12 that may be configured to be received in or around an open end of the container. In embodiments, the base 12 may be secured to the container via threads. In embodiments, the base 12 may be secured to the container via any suitable connection.

Figure 3:
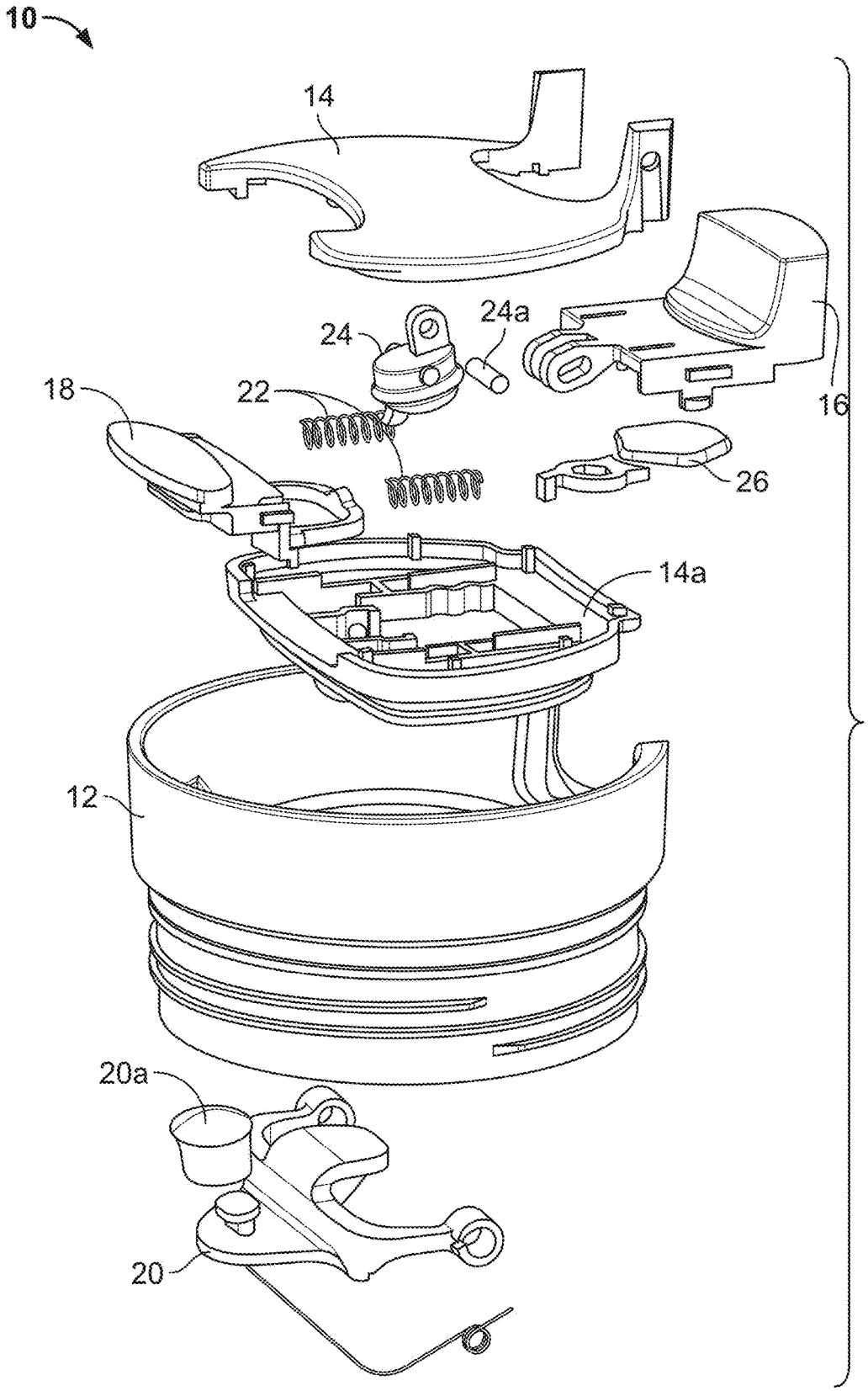
FIG. 3 illustrates an exploded view of the lid of FIGS. 1 and 2 in accordance with an embodiment of the present disclosure.
Figure 4B:
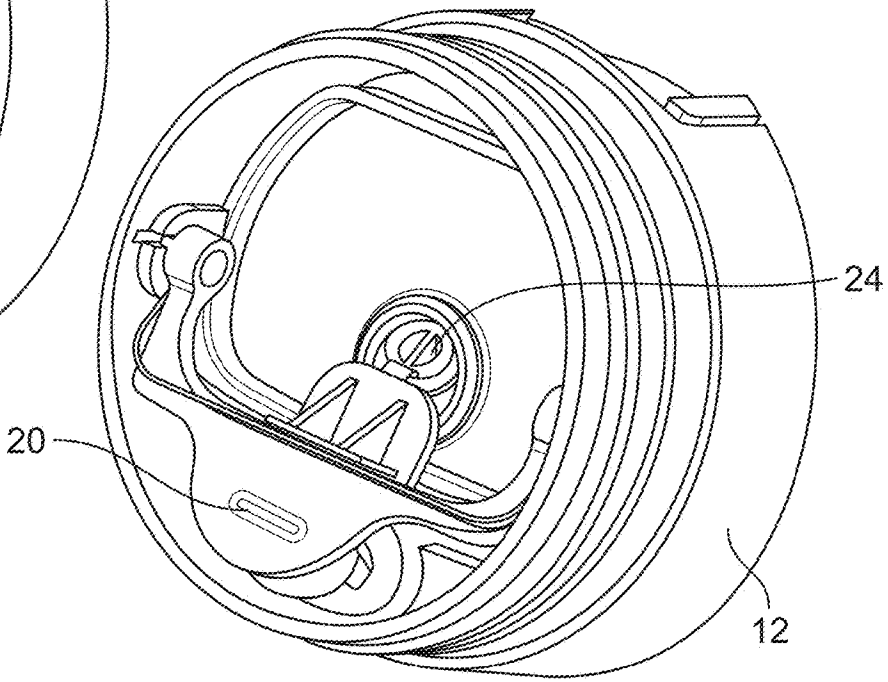
FIG. 4B illustrates a bottom view of the lid of FIGS. 1 and 2 with the first cover in an open position in accordance with an embodiment of the present disclosure.
Figure 4A:
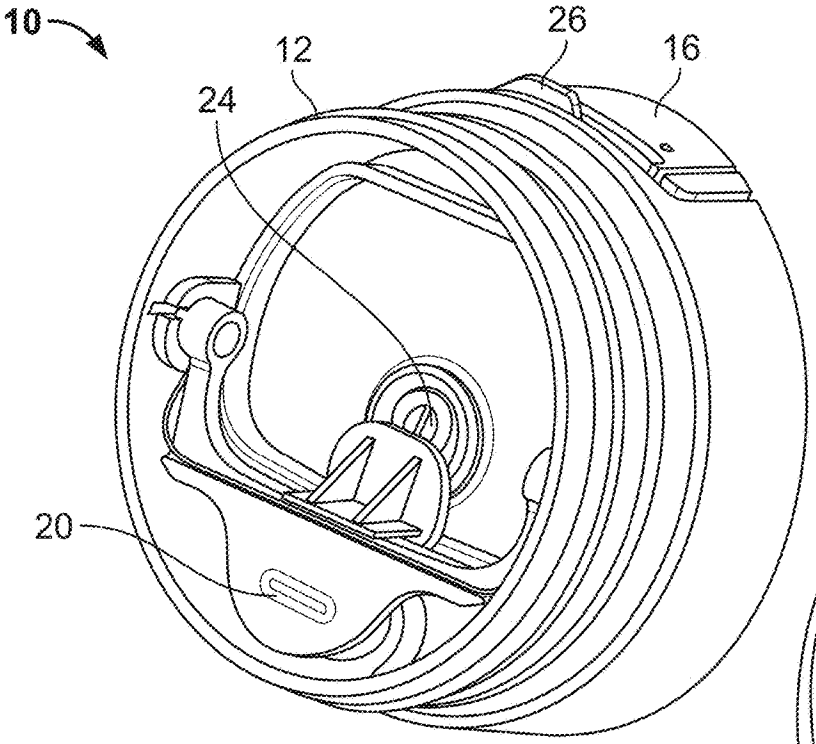
FIG. 4A illustrates a bottom view of the lid of FIGS. 1 and 2 with the first cover in a closed position in accordance with an embodiment of the present disclosure.

In embodiments, the lid 10 may include a drinking opening 30 provided on one side thereof to allow a user to drink out of the container while the lid is in place. In embodiments, the drinking opening 30 may be provided in a depression formed on one side of the lid 10 and defined by the wall of the base 12 and a depression wall 12*a*. In embodiments, the drinking opening 30 may be selectively covered or sealed by a first first seal 20*a* (see FIG. 3, for example) provided on a drinking opening arm 20 and configured to seal the drinking opening 30 when the drinking opening arm is in a closed position (see FIG. 4A, for example). In embodiments, the drinking opening arm 20 may be rotatably mounted such that it is movable between the closed position in which the first seal 20*a* is positioned in the opening 30 as shown in FIG. 4A and an open position in which the seal 20*a* separated from the opening 30 as illustrated in FIG. 4B to allow fluid to pass through the drinking opening. The drinking opening arm 20 is movable based on actuation of the first actuator 16. In embodiments, the first actuator 16 may be connected to a pivot element (pivot disk) 24 (see FIG. 4, for example) which is, in turn, connected to the drinking opening arm 20 such that pivoting of the pivot element moves the drinking opening arm 20 into and out of the closed position. In embodiments, a pin 24*a* may be provided to connect the actuator 16 to the pivot element 24 such that movement of the actuator 16 inward pivots the pivot element 24 to move the drinking opening arm 20 and the seal 20*a* into the open position.

Figure 6B:
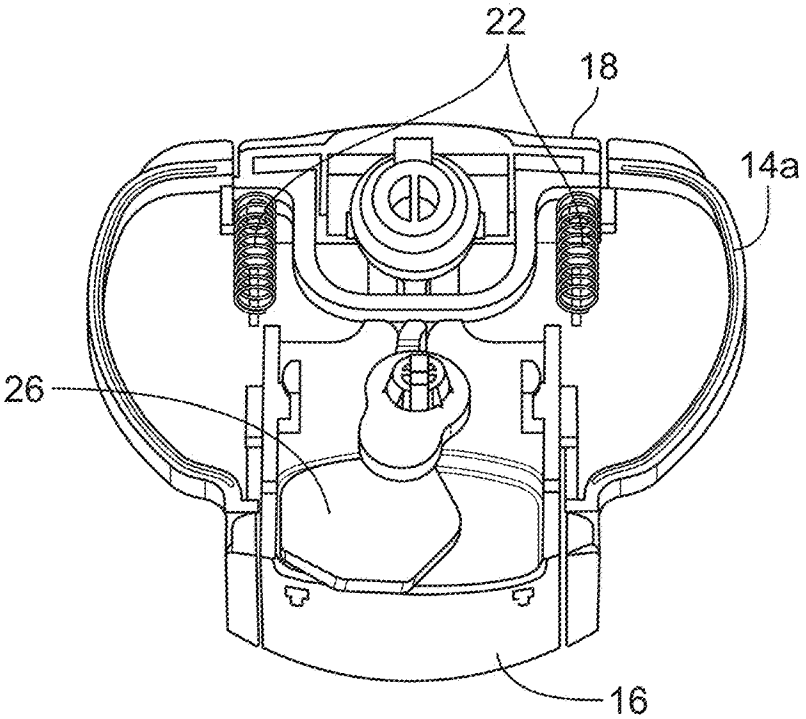
FIG. 6B illustrates a detailed view of the lock element in FIG. 6A in a locked position which prevents actuation of both the first actuator and the second actuator in accordance with an embodiment of the present disclosure.
Figure 6A:
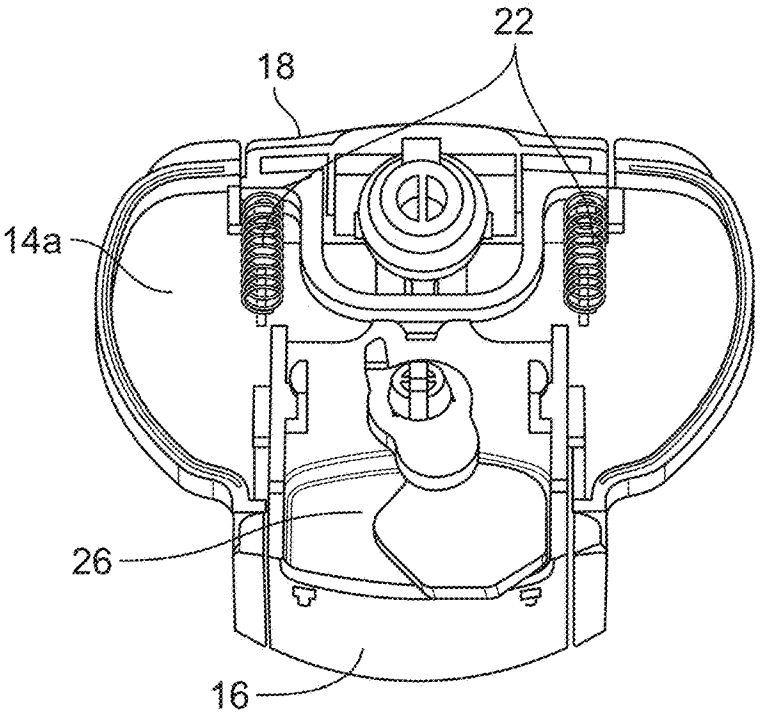
FIG. 6A illustrates a detailed view of a lock element in an unlocked position allowing actuation of the first actuator and the second actuator in accordance with an embodiment of the present disclosure.

In embodiments, the first actuator 16 is mounted in the second cover 14, and specifically in a base 14*a* thereof. In embodiments, the first actuator 16 may be a slider but any suitable actuator may be used. In embodiments, the actuator 16 may be biased to keep the seal 20*a* in the opening 30 via one or more biasing element 22. In embodiments, the biasing element 22 may include a pair of springs, as illustrated in FIGS. 6A and 6B, for example. In embodiments, any suitable biasing element may be used.

Figure 5B:
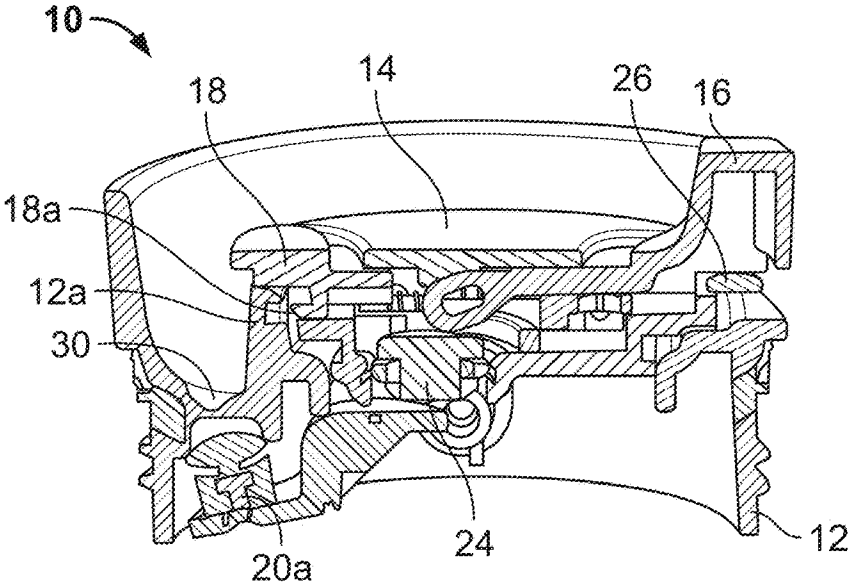
FIG. 5B illustrates a cross-section of the lid showing the second actuator in a second position to release the second cover such that the second cover is movable into an open position in accordance with an embodiment of the present disclosure.
Figure 5A:
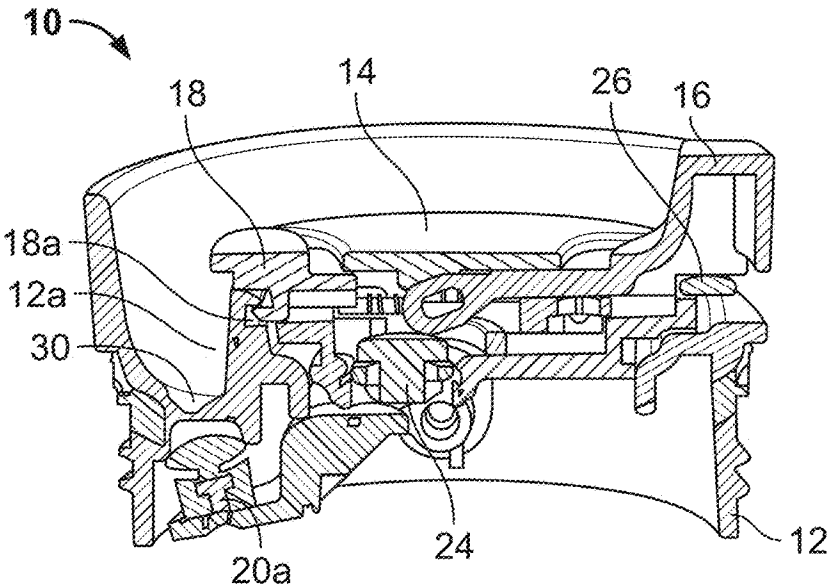
FIG. 5A illustrates a cross-section of the lid showing the second actuator in a first position to hold the second cover in place in accordance with an embodiment of the present disclosure.
Figure 7B:
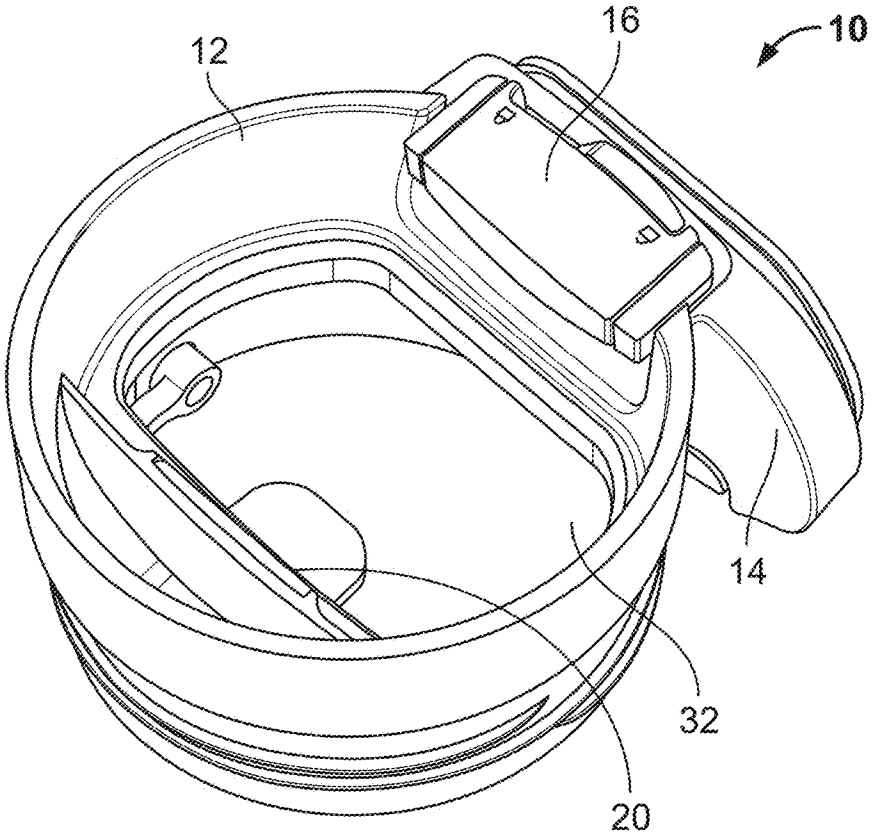
FIG. 7B illustrates the second cover in an open position in accordance with an embodiment of the present disclosure.
Figure 7A:
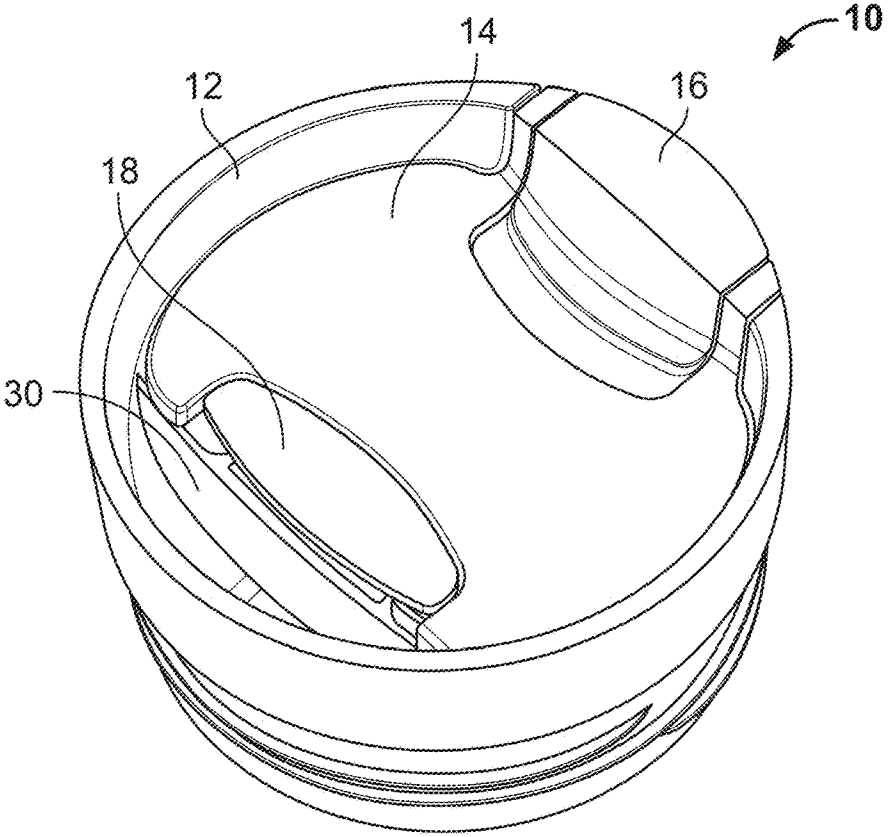
FIG. 7A illustrates the second cover in the closed position in accordance with an embodiment of the present disclosure.

In embodiments, the second cover 14 is rotatable between a closed position as illustrated in FIG. 7A, for example, and an open position illustrated in FIG. 7B, for example. In embodiments, the second cover 14 may be held in the closed position via the tab 18*a* provided on the second actuator 18, which engages with the base 12, and more specifically a slot formed in the wall 12*a*. In embodiments, the second actuator 18 is biased such that the tab 18*a* engages the base 12 to hold the second cover 14 in the closed position. The one or more biasing element 22 may provide this bias force as well. FIG. 5A illustrates a cross-section of the lid 10 with the tab 18*a* engaged in the base 12. In particular, in embodiments, the tab 18*a* may be received in a slot formed in the depression wall 12*a*, as noted above. In embodiments, when the actuator 18 is pushed inward, toward a center axis of the lid 10, the tab 18*a* is separated from the wall 12*a* such that the second cover 14 may be rotated substantially 180 degrees as shown in FIG. 7B, for example, such that the central filling opening 32 in the lid 10 is entirely exposed. In embodiments, this central filling opening 32 is larger than the drinking opening 30 such that the container can be refilled while the lid 10 is still on the container.

In embodiments, the lid 10 may include a locking element 26 that may be used to lock the first actuator 16 and the second actuator 18 in place to keep the first cover 20 and the second cover 14 closed. FIG. 6B illustrates the lock element 26 in the locked position that prevents movement of both the first actuator 16 and the second actuator 18 such that the lid 10 is sealed and no fluid can flow through either the drinking opening 30 or the filling opening 32. In embodiments, in the locked position, the tab 26*a* of the lock element 26 contacts the second actuator 18 to prevent it from moving forward. The lock element 26 also engages the first actuator 14 such that movement of the first actuator 16 is also prevented. In embodiments, when the lock element 26 is in the unlocked position of FIG. 6A, both the first actuator 16 and the second actuator 18 may be actuated to selectively open the drinking opening 30 and the filling opening 32.

In operation, the user will push inward on the first actuator 16 such that the drinking opening arm 20 pivots to move the seal 20*a* out of the drinking opening 30 to allow the user to drink. As noted above, the second actuator 18 is biased in the closed position such that the tab 18*a* holds the second cover 14 closed. In embodiments, where a user wants to refill the container, the user will push the second actuator inward, moving the tab 18*a* out of the slot in the wall 12*a* and will lift up such that the second cover 14 moves to the open position to allow the to refill the container using the opening 32 while the lid 10 remains on the container. When done, the second cover 14 is returned to the closed position and held in place by the tab 18*a* to ensure that the fluid stays in the container.

Although the present invention has been described in relation to particular embodiments thereof, many other variations and modifications and other uses will become apparent to those skilled in the art. It is preferred, therefore, that the present invention be limited not by the specific disclosure herein.

What is claimed is:

1. A lid for a container comprises:

a base configured to be secured to an open end of a container;

the base including:

a central filling opening configured for fluid communication with the open end of the container;

a first cover movably mounted in the base and movable between a closed position covering the central opening and an open position in which the central opening is open;

a first actuator operatively connected to the first cover and configured to selectively secure the first cover in the closed position such that the first cover is movable to the open position after activation of the first actuator;

a drink opening provided on one side of the base and separate from the central opening;

a drink opening seal movably mounted in the base and configured to move from a first position sealing the drink opening and a second position in which the drink opening is exposed, the drink opening seal biased in the first position; and a second actuator mounted in the first cover and operably connected to the drink opening seal assembly such that activation of the second actuator moves the drink opening seal into the second position.

2. The lid of claim 1, wherein the central filling opening is larger than the drink opening and configured for filling of the container with fluid.

3. The lid of claim 1, wherein the first actuator comprises a first protrusion configured to engage the base to hold the first cover in the closed position, where the first actuator is movable in a first direction to move the first protrusion away from the base to allow the first cover to move to the open position.

4. The lid of claim 3, wherein the base includes a first slot formed in a sidewall thereof and configured to receive the first protrusion.

5. The lid of claim 1, wherein the drink opening seal is biased into the first position to seal the drink opening.

6. The lid of claim 1, wherein the drink opening seal is mounted on a first end of a drink opening arm, wherein the drink opening arm is movably mounted on the base and operably connected to the first actuator to move the drink opening seal from the first position to the second position.

7. The lid of claim 6, wherein the second actuator slides from a first position in which the drink opening seal is covered, inward, toward a central axis of the lid, to move the drink opening seal to the second position in which the drink opening seal uncovers to drink opening to allow fluid to pass out of the drink opening.

8. The lid of claim 7, further comprising a pivot disk mounted in the first cover and in contact with the drink opening arm and the second actuator, wherein the pivot disk is substantially flush with a bottom surface of the first cover when the drink opening seal is in the first position and pivots downward to push down on the drink opening arm to move the drink opening seal to the second position to uncover the drink opening when the second actuator slides into the second position.

9. The lid of claim 8, further comprising a pin configured to connect a distal end of the second actuator to the pivot disk such that movement of the second actuator toward the central axis of the lid pivots the pivot disk downward.

10. The lid of claim 9, wherein the distal end of the second actuator includes a downward angled loop and the pivot disk includes an upwardly extending loop, wherein the pin extends through the downward angled loop and the upwardly extending loop such that movement of the second actuator inward toward the central axis moves the pivot disk down.

11. The lid of claim 1, wherein a lock element is mounted in the second cover and movable between a locked position in which activation of the first actuator and the second actuator is prevented and an unlocked position wherein the first actuator and the second actuator are movable.

12. The lid of claim 11, wherein the lock element is configured to selectively lock the first actuator and the second actuator to prevent activation.

* * * * *